US005752447A

United States Patent [19]

Theurer et al.

[11] Patent Number: 5,752,447

[45] Date of Patent: May 19, 1998

[54] TAMPING MACHINE

[75] Inventors: Josef Theurer, Vienna; Friedrich Peitl, Linz, both of Austria

[73] Assignee: Franz Plasser Bahnbaumaschinen-Industriegesellscaft m.b.H., Vienna, Austria

[21] Appl. No.: 767,965

[22] Filed: Dec. 17, 1996

[30] Foreign Application Priority Data

Jan. 12, 1996 [AT] Austria ..... 50/96

[51] Int. Cl.[6] ..... E01B 27/00

[52] U.S. Cl. ..... 104/12

[58] Field of Search ..... 104/12, 10, 2

[56] References Cited

U.S. PATENT DOCUMENTS

| | | | |
|---|---|---|---|
| 4,537,135 | 8/1985 | Theurer | 104/12 |
| 4,825,768 | 5/1989 | Theurer et al. . | |
| 4,903,608 | 2/1990 | Theurer et al. | 104/12 |
| 4,905,604 | 3/1990 | Theurer . | |
| 4,942,821 | 7/1990 | Rossanigo . | |
| 4,947,757 | 8/1990 | Theurer | 104/12 |
| 5,007,350 | 4/1991 | Theurer | 104/12 |
| 5,133,263 | 7/1992 | Theurer | 104/12 |
| 5,269,226 | 12/1993 | Theurer et al. | 104/12 |
| 5,379,700 | 1/1995 | Theurer . | |
| 5,515,788 | 5/1996 | Theurer et al. | 104/12 |
| 5,617,793 | 4/1997 | Theurer | 104/12 |
| 5,619,929 | 4/1997 | Theurer | 104/12 |

FOREIGN PATENT DOCUMENTS

| | | |
|---|---|---|
| 351070 | 7/1979 | Austria . |
| 2005187 | 8/1971 | Germany . |

*Primary Examiner*—Mark T. Le
*Attorney, Agent, or Firm*—Collard & Roe, P.C.

[57] ABSTRACT

A ballast tamping machine comprises a machine frame supported on a track by undercarriages for moving in an operating direction, a track lifting and lining unit mounted on the machine frame and operable to correct the track position, a reference system controlling lifting and lining of the track by the track lifting and lining unit, and two adjoining tamping heads arranged sequentially on the machine frame in the longitudinal direction at a respective track rail. Each tamping head comprises ballast tamping tools reciprocable towards each other in the longitudinal direction at the gage side and the field side of the rail, drives for vertically adjusting the ballast tamping tools of each tamping head independently of the vertical adjustment of the ballast tamping tools of the other tamping head for immersing tamping picks on the ballast tamping tools in the ballast underneath the track. The tamping picks on the ballast tamping tools of only one of the tamping heads are pivotal in a plane extending transversely to the longitudinal direction about an axis extending at least approximately in the longitudinal direction to adapt the one tamping head for operation in switches, and pivoting drives are linked to the tamping picks on the ballast tamping tools of the one tamping head for pivoting the same.

6 Claims, 2 Drawing Sheets

TAMPING MACHINE

BACKGROUND OF THE INVENTION

1. Field of the Invention

The present invention relates to a machine for tamping ballast underneath a track comprised of two rails fastened to ties spaced to define cribs therebetween, each rail having a gage side and a field side, the machine comprising a machine frame extending in a longitudinal direction and supported on the track by undercarriages for moving in an operating direction, a track lifting and lining unit mounted on the machine frame and operable to correct the track position, a reference system controlling lifting and lining of the track by the track lifting and lining unit, and two adjoining tamping heads arranged sequentially on the machine frame in the longitudinal direction at a respective one of the rails. Each tamping head comprises ballast tamping tools reciprocable towards each other in the longitudinal direction at the gage side and the field side of the rail, drives for reciprocating the ballast tamping tools, and drives for vertically adjusting the ballast tamping tools of each tamping head independently of the vertical adjustment of the ballast tamping tools of the other tamping head for immersing tamping picks on the ballast tamping tools in the ballast underneath the track.

2. Description of the Prior Art

A machine of this general type is known, for example, from U.S. Pat. No. 4,942,821. This machine comprises a track lifting and lining unit and a total of four like ballast tamping tool assemblies Adjoining pairs of ballast tamping tools are arranged sequentially in the longitudinal direction at each rail and they are individually connected with the machine frame for vertical adjustment. During tamping in tangent track, which is free of switches, all four tamping tool assemblies are lowered for immersion of their tamping picks in the ballast underneath the track, and the ballast tamping tools are reciprocated towards each other by pivoting them about axes extending transversely to the longitudinal direction. When the machine is used in a switch, only one tamping tool assembly per rail is lowered while the other tamping tool assembly remains in its raised, inoperative position. There is also the possibility of pivoting each ballast tamping tool independently into a horizontally extending rest position when, for instance, an obstacle is encountered to prevent this ballast tamping tool from operating. In this case, the single immersed ballast tamping tool presses against the ballast against counter-pressure, which makes the tamping ineffective. An optimal ballast tamping cannot be achieved in switches with this machine.

Tamping machines for tamping ballast under a succession of ties simultaneously along a tangent track are well known, for example from Austrian patent No. 351,070 and published German patent application No. 2,005,187. Operation in switches is not possible with these machines.

Switch tamping machines with two sequentially arranged tamping heads for the simultaneous tamping of a plurality of adjacent ties are also known. U.S. Pat. Nos. 4,825,768 and 4,905,604 disclose a switch tamper with vertically adjustable tamping heads whose reciprocable ballast tamping tools have laterally pivotal tamping picks. An auxiliary tamping device is connected to the carrier frame of the main tamping head and can be transversely displaced by a telescoping guide to the outer rail of a branch track for tamping ballast under that rail. This auxiliary tamping device has a single pair of reciprocable tamping tools for immersion along a single side of the outer rail. If the ballast on the other side of the outer rail is to be tamped, too, the ballast tamping tools must be raised out of the ballast, then transversely displaced to the other rail side and finally immersed again.

Finally, it is known from U.S. Pat. No. 5,379,700 to provide a two-machine arrangement for tamping track in switches. A first tamping machine comprises lifting means for raising track switch sections and is used in tangent track and for lifting switch sections, which are rapidly fixed in their desired position. The second machine follows the first one and is used to finish tamping the rapidly fixed switch section without being under time pressure.

SUMMARY OF THE INVENTION

It is the primary object of this invention so to improve a ballast tamping machine of the first-described type that it is capable of obtaining optimal ballast tamping in tangent track as well as in track switch sections.

The invention accomplishes this and other objects with tamping picks on the ballast tamping tools of only one of the tamping heads being pivotal in a plane extending transversely to the longitudinal direction about an axis extending at least approximately in the longitudinal direction to adapt the one tamping head for operation in switches, and providing pivoting drives for pivoting the tamping picks on the ballast tamping tools of the one tamping head.

In this manner, a single machine for the first time is equipped with a special type of tamping head designed for work in switches as well as a highly efficient tamping head designed for work in tangent track free of switches. This has the advantage that track sections with only short stretches free of switches may be optimally tamped with the two different tamping heads without requiring time-consuming retrofitting. Thus, both types of track sections may be tamped in a single operating cycle as the machine moves along the track, which assures a more uniform correction of the track position and a long-lasting ballast compaction to fix the track in the corrected position.

BRIEF DESCRIPTION OF THE DRAWING

The above and other objects, advantages and features of the present invention will become more apparent from the following detailed description of a now preferred embodiment thereof, taken in conjunction with the accompanying drawing wherein.

DETAILED DESCRIPTION OF PREFERRED EMBODIMENT

Figure 1:
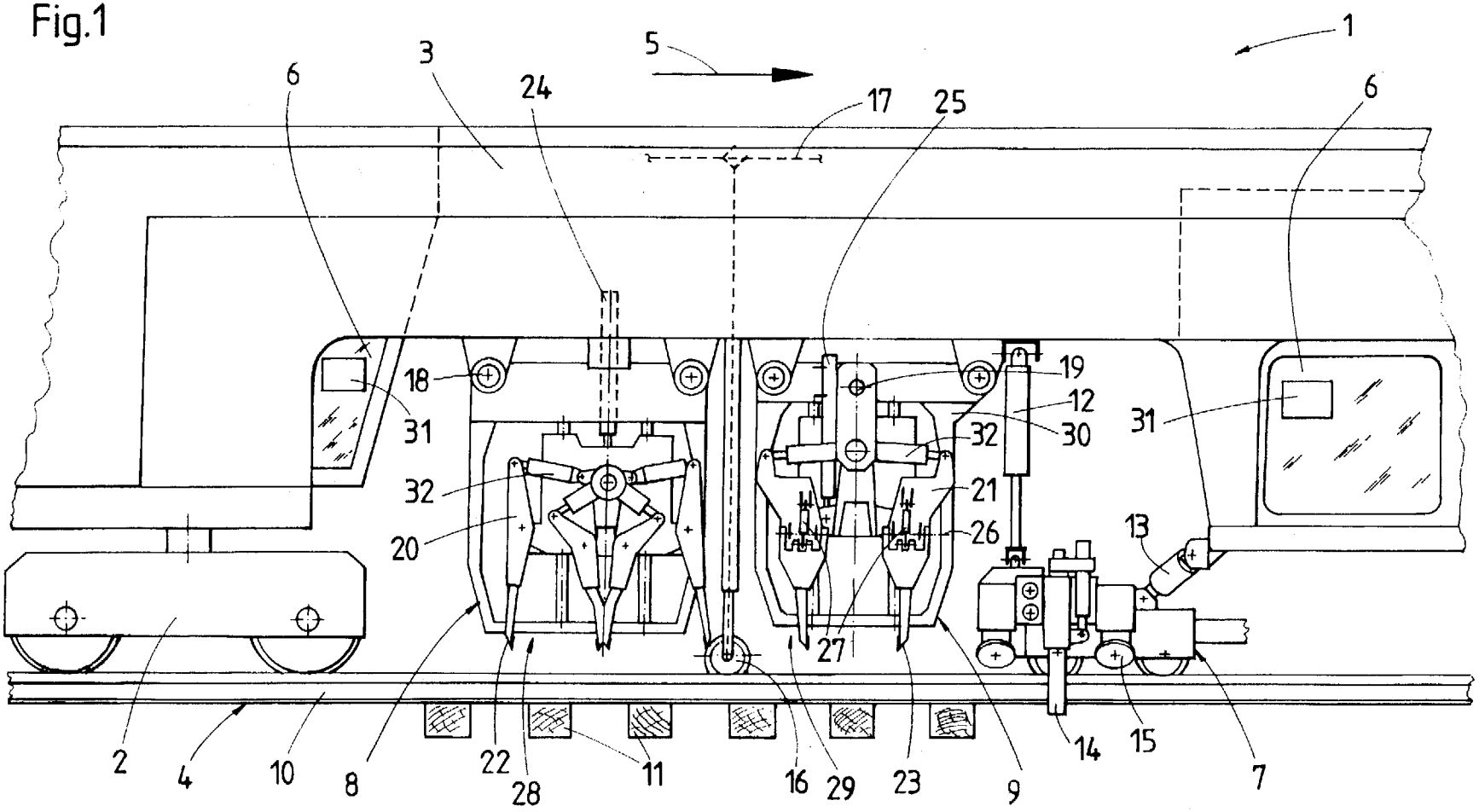
FIG. 1 is a fragmentary side elevational view of a ballast tamping machine showing a tamping head arrangement according to this invention.

Referring now to the drawing and first to FIG. 1, there is shown machine 1 for tamping ballast underneath track 4 comprised of two rails 10 fastened to ties 11 spaced to define cribs therebetween. Each rail 10 has a gage side and a field side. Ballast tamping machine 1 comprises machine frame 4 extending in a longitudinal direction and supported on track 4 by undercarriages 2 for moving in an operating direction indicated by arrow 5. The ballast tamping machine further comprises two operator's cabs 6, 6 mounted on machine frame 3 and spaced from each other in the longitudinal direction. Each cab houses a control panel 31 for operating a respective one of adjoining tamping heads 8, 9 arranged on the machine frame between the cabs and sequentially in the longitudinal direction at rail 10. A track lifting and lining unit 7 is also mounted on machine frame 3 between operator's cabs 6, 6 and is operable to correct the track position. The generally conventional track lifting and lining unit 7 comprises roller lifting clamps 15 and lifting hooks 14 arranged for engagement with rail 10 and is linked to machine frame 3 by vertical adjustment drives 12 and lining drives 13. Reference system 17 is also carried by the machine frame for controlling lifting and lining of track 6 by track lifting and lining unit 17. The references system comprises track position measuring axle 16 rolling on the track and sensing the position of rails 10. Measuring axle 16 is vertically adjustably mounted on machine frame 3 and is arranged between the two tamping heads 8, 9.

Figure 2:
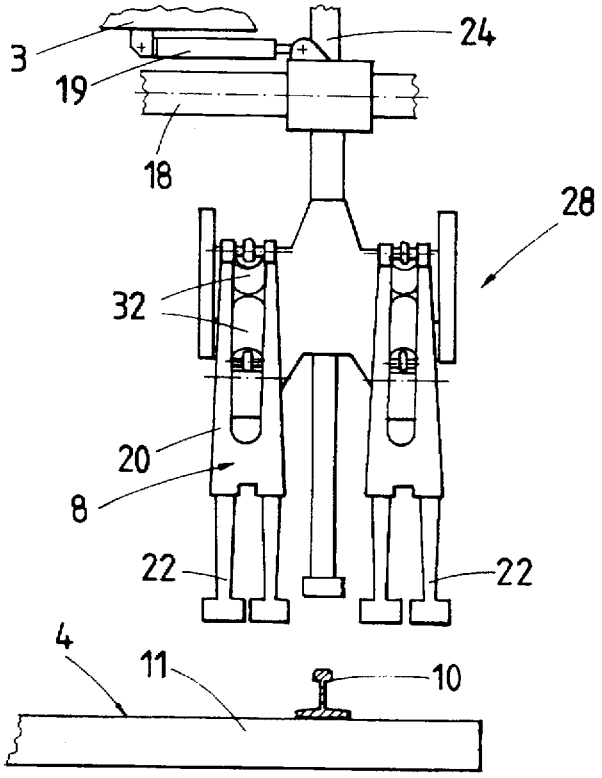
FIGS. 2 and 3 are fragmentary and somewhat schematic end views showing the ballast tamping tools of the sequentially arranged tamping heads.
Figure 3:
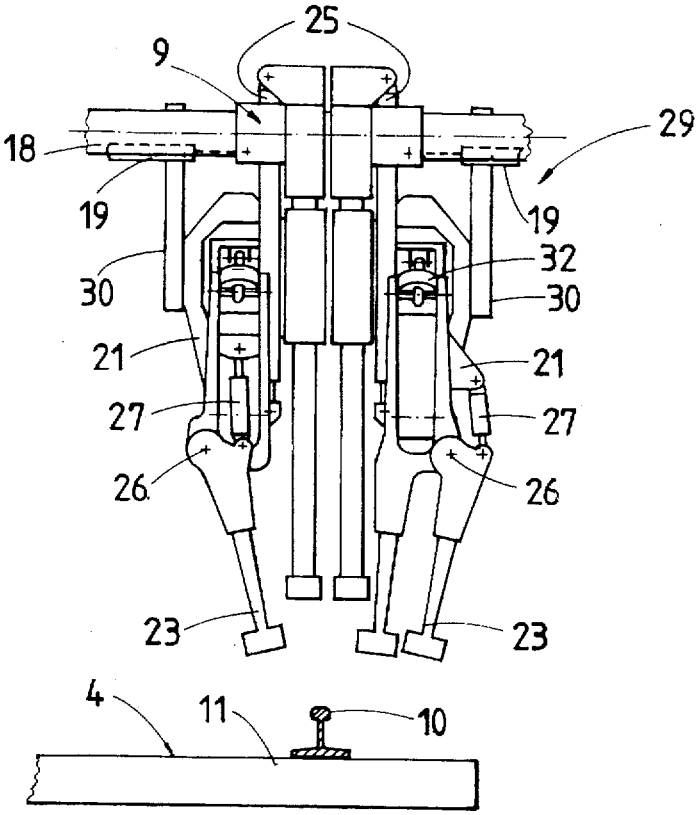

Each of the two adjoining tamping heads 8, 9 comprises ballast tamping tools 20, 21 reciprocable towards each other in the longitudinal direction at the gage side and the field side of rail 10, as shown in FIGS. 2 and 3. Drives 32 are linked to the ballast tamping tools for reciprocating the same, and drives 24, 25 are arranged for vertically adjusting the ballast tamping tools of each tamping head independently of the vertical adjustment of the ballast tamping tools of the other tamping head for immersing tamping picks 22, 23 on the ballast tamping tools 20, 21 in the ballast underneath track 4. To enable the ballast to be tamped at each rail 10, two sequentially arranged tamping heads 8, 9 are provided at each rail.

As best shown in FIGS. 2 and 3, the two tamping heads are mounted for displacement transversely to the longitudinal direction on horizontally extending, transverse guide rods 18, and displacement drives 19 are connected to the tamping heads for transversely displacing them.

As shown in FIG. 3, tamping picks 23 on ballast tamping tools 21 of tamping head 9 are pivotal in a plane extending transversely to the longitudinal direction about axis 26 extending at least approximately in the longitudinal direction to adapt this tamping head for operation in switches, and pivoting drives 27 are linked to tamping picks 23 for pivoting the tamping picks on ballast tamping tools 21 of tamping head 9. This makes tamping head 9 into a tamping head 29 designed for operation in switches.

The tamping head 29 is arranged ahead of the other tamping head 8 in the operating direction and comprises only a single pair of ballast tamping tools 21 at the gage side and at the field side of rail 10, and ballast tamping tools 22 on the other tamping head 8 are arranged for operating in tangent track free of switches so that this tamping head is a tamping head 28 designed for efficient operation in tangent track.

As shown in FIG. 1, the other tamping head 28 has two pairs of ballast tamping tools 20 arranged to have their tamping picks 22 immersed in the ballast in adjoining cribs, and a separate drive 32 for reciprocating the ballast tamping tools is connected to each pair of the ballast tamping tools. Such tamping heads designed for the simultaneous tamping of two adjacent ties are well known and are of proven effectiveness in track tamping.

As shown in FIGS. 1 and 3, switch tamping head 29 comprises only a single pair of ballast tamping tools 21 at the gage side and at the field side of rail 10. Each tamping tool forms an independent tamping unit 30 mounted for displacement transversely to the longitudinal direction along guide rod 18 by separate displacement drives 19, and separate drives 25 are provided for vertically adjusting each tamping unit 30 independently.

In operation, if a track 4 with changing track characteristics is to be tamped, either tamping head 28 or 29 is operated, depending on whether machine 1 operates in a tangent track section or in a track switch section. This selective operation of the tamping heads is controlled by operators in cabs 6, one of the cabs being arranged within view of one tamping head and the other cab being within view of the other tamping head. Tangent track sections will preferably be tamped with tamping head 28 in the most efficient manner adapted for this purpose. This tamping head may also be used in track curves since it is transversely displaceable. When a switch is to be tamped, the tamping head is raised into its inoperative position and only tamping head 29 is immersed. With its four separate and independently operable tamping units 30 at each side of rail 10 and the possibility of swinging individual tamping picks 23 out of their operating position with the aid of pivoting drives 27, switch tamping head 29 is well adapted to conform to all sorts of rail configurations in switches. At the same time, tamping heads 29 may also be used in tangent track sections where some obstacle is encountered along a rail, which makes the immersion of tamping head 28 with its fixed tamping picks impossible. The change between using one or the other tamping head can be effected smoothly by the operators in cabs 6 without requiring any retrofitting.

What is claimed is:

1. A machine for tamping ballast underneath a track comprised of two rails fastened to ties spaced to define cribs therebetween, each rail having a gage side and a field side, the machine comprising (a) a machine frame extending in a longitudinal direction and supported on the track by undercarriages for moving in an operating direction, (b) a track lifting and lining unit mounted on the machine frame and operable to correct the track position, (c) a reference system controlling lifting and lining of the tract by the track lifting and lining unit, and (d) two adjoining tamping heads arranged sequentially on the machine frame in the longitudinal direction at a respective one of the rails, each tamping head comprising (1) ballast tamping tools reciprocable towards each other in the longitudinal direction at the gage side and the field side of the rail, (2) drives for reciprocating the ballast tamping tools, (3) drives for vertically adjusting the ballast tamping tools of each tamping head independently of the vertical adjustment of the ballast tamping tools of the other tamping head for immersing tamping picks on the ballast tamping tools in the ballast underneath the track, (4) the tamping picks on the ballast tamping tools of only one of the tamping heads being pivotal in a plane extending transversely to the longitudinal direction about an axis extending at least approximately in the longitudinal direction to adapt the one tamping head for operation in switches, (5) pivoting drives for pivoting the tamping picks on the ballast tamping tools of the one tamping head, and (6) two operator's cabs mounted on the machine frame and spaced from each other in the longitudinal direction, the two tamping heads being arranged between the cabs, and each cab housing a control panel for operating a respective one of the tamping heads.

2. The ballast tamping machine of claim 1, wherein the one tamping head is arranged ahead of the other tamping head in the operating direction and comprises only a single pair of ballast tamping tools at the gage side and at the field side of the rail, and the ballast tamping tools on the other tamping head are arranged for operating in tangent track free of switches.

3. The ballast tamping machine of claim 2, wherein the other tamping head has two pairs of ballast tamping tools arranged to have their tamping picks immersed in the ballast in adjoining ones of the cribs, and a separate one of the drives for reciprocating the ballast tamping tools is connected to each pair of the ballast tamping tools.

4. The ballast tamping machine of claim 1, wherein the reference system comprises a track position measuring axle rolling on the track and sensing the position of the rails, the measuring axle being arranged between the two tamping heads.

5. The ballast tamping machine of claim 1, wherein the two tamping heads are mounted for displacement transversely to the longitudinal direction, further comprising displacement drives for transversely displacing the tamping heads.

6. The ballast tamping machine of claim 1, wherein the one tamping head comprises only a single pair of ballast tamping tools at the gage side and at the field side of the rail, each pair forming two separate tamping units mounted for displacement transversely to the longitudinal direction, and comprising separate drives for vertically adjusting and transversely displacing each tamping unit independently.

* * * * *